US009373904B2

(12) United States Patent
Binner

(10) Patent No.: US 9,373,904 B2
(45) Date of Patent: Jun. 21, 2016

(54) PIN CONTACT ELEMENT AND ELECTRONICS HOUSING

(71) Applicant: WAGO Verwaltungsgesellschaft mbH, Minden (DE)

(72) Inventor: Lars Binner, Melle (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 14/410,860

(22) PCT Filed: Jun. 24, 2013

(86) PCT No.: PCT/EP2013/063124

§ 371 (c)(1),
(2) Date: Dec. 23, 2014

(87) PCT Pub. No.: WO2014/001250

PCT Pub. Date: Jan. 3, 2014

(65) Prior Publication Data

US 2015/0188248 A1 Jul. 2, 2015

(30) Foreign Application Priority Data

Jun. 25, 2012 (DE) ..... 10 2012 105 508

(51) Int. Cl.
*H01R 13/04* (2006.01)
*H01R 12/71* (2011.01)
(Continued)

(52) U.S. Cl.
CPC ..... *H01R 12/71* (2013.01); *H01R 9/2608* (2013.01); *H01R 9/2625* (2013.01); *H01R 12/75* (2013.01); *H01R 12/515* (2013.01)

(58) Field of Classification Search
CPC .. H01R 24/28; H01R 2103/00; H01R 13/405; H01R 13/055; H01J 5/54
USPC ..... 439/692, 468, 224, 397
See application file for complete search history.

(56) References Cited

U.S. PATENT DOCUMENTS 2,319,564 A * 5/1943 Smith ..... H01J 5/54 439/379
2,449,374 A * 9/1948 Kronouer ..... H01J 5/54 439/379

(Continued)

FOREIGN PATENT DOCUMENTS

DE 197 14 878 C1 8/1998
DE 20 2007 005 387 U1 7/2007

(Continued)

OTHER PUBLICATIONS

International Search Report dated Sep. 20, 2013 corresponding to application No. PCT/EP2013/063124 filed on Jun. 24, 2013.

(Continued)

*Primary Examiner* — Abdullah Riyami
*Assistant Examiner* — Vladimir Imas
(74) *Attorney, Agent, or Firm* — Renner, Otto, Boisselle & Sklar, LLP

(57) ABSTRACT

The invention describes a pin contact element (1) having a contact support (2) which is composed of insulating material and having at least two pin contacts (3*a*, 3*b*, 3*c*, 3*d*) which are installed in the contact support (2). The pin contact element (1) is intended to be installed in an electronics device housing (13) and to be connected to a printed circuit board. The pin contacts (3*a*, 3*b*, 3*c*, 3*d*) project from a platform (5) of the contact support (2) in order to receive a spring-force plug connector (19) by way of a straight contact section (4). The contact sections (4) of the pin contacts (3*a*, 3*b*, 3*c*, 3*d*) are surrounded in a fixing region (6) of the platform (5) by the contact support (2) and the pin contacts (3*a*, 3*b*, 3*c*, 3*d*) are secured in the contact support (2) in the fixing region. At least one of the pin contacts (3*a*, 3*b*, 3*c*, 3*d*) is routed past at least one further pin contact (3*a*, 3*b*, 3*c*, 3*d*) of the same pin contact element (1) such that it adjoins the straight contact section (4) by way of at least two angled portions (8). At least two pin contacts (3*a*, 3*b*, 3*c*, 3*d*) are arranged with their straight contact sections (4) in a row next to one another. The opposite free ends (7*a*, 7*b*, 7*c*, 7*d*) of these pin contacts (3*a*, 3*b*, 3*c*, 3*d*), which free ends are intended to be connected to a printed circuit board, extend parallel to the direction (R) in which the straight contact sections (4) are lined up next to one another in at least one row, and project laterally out of the contact support (2).

11 Claims, 12 Drawing Sheets

(51) Int. Cl.

| | |
|---|---|
| ***H01R 9/26*** | (2006.01) |
| ***H01R 12/75*** | (2011.01) |
| *H01R 12/51* | (2011.01) |

(56) References Cited

U.S. PATENT DOCUMENTS

| | | | | | |
|---|---|---|---|---|---|
| 2,502,307 | A * | 3/1950 | Bascom | H01R 24/28 | 439/379 |
| 3,202,959 | A * | 8/1965 | Keller | H01R 13/432 | 439/685 |
| 3,219,965 | A * | 11/1965 | Adamo | H01J 5/54 | 439/618 |
| 3,278,886 | A * | 10/1966 | Blumenberg | H01J 5/54 | 313/313 |
| 3,771,105 | A * | 11/1973 | Yamazaki | H01J 5/54 | 439/150 |
| 4,281,888 | A * | 8/1981 | Seaman | G01R 1/073 | 439/620.27 |
| 4,384,757 | A * | 5/1983 | Andrews, Jr. | H01R 23/72 | 439/65 |
| 4,639,056 | A * | 1/1987 | Lindeman | H01R 13/405 | 29/841 |
| 4,820,179 | A * | 4/1989 | Saijo | H01R 4/2466 | 439/224 |
| 5,108,317 | A * | 4/1992 | Beinhaur | H01R 43/24 | 264/274 |
| 5,564,952 | A * | 10/1996 | Davis | H01R 13/113 | 439/682 |
| 5,879,610 | A * | 3/1999 | Beinhaur | B29C 45/14639 | 264/272.11 |
| 6,106,341 | A * | 8/2000 | Leach, III | H01R 13/055 | 439/796 |
| 6,848,953 | B2 * | 2/2005 | Schell | H01R 13/055 | 439/825 |
| 7,374,436 | B2 * | 5/2008 | Schell | H01R 13/055 | 439/79 |
| 7,604,505 | B2 * | 10/2009 | Zayas | H01J 5/54 | 439/236 |
| 7,828,585 | B2 * | 11/2010 | Kurimoto | H01R 13/02 | 439/357 |
| 8,162,679 | B2 * | 4/2012 | Ko | H01R 4/2454 | 439/401 |
| 8,894,451 | B2 * | 11/2014 | Shiratori | H01R 13/6471 | 439/660 |
| 9,178,328 | B2 * | 11/2015 | Heppner | H01R 43/24 | |
| 2006/0223379 | A1 | 10/2006 | Ho | | |

FOREIGN PATENT DOCUMENTS

| | | | |
|---|---|---|---|
| DE | 10 2007 018 443 | A1 | 11/2007 |
| DE | 10 2009 035 716 | A1 | 2/2011 |
| EP | 0 685 906 | A1 | 12/1995 |
| EP | 1 729 370 | A2 | 12/2006 |
| EP | 2 088 842 | A2 | 8/2009 |
| EP | 2 120 296 | A1 | 11/2009 |
| EP | 2 280 453 | A1 | 2/2011 |
| WO | 02/095878 | A1 | 11/2002 |
| WO | 2008/086863 | A1 | 7/2008 |
| WO | 2008/125315 | A2 | 10/2008 |

OTHER PUBLICATIONS

International Preliminary Report on Patentability dated Jan. 8, 2015 corresponding to application No. PCT/EP2013/063124 filed on Jun. 24, 2013.

* cited by examiner

PIN CONTACT ELEMENT AND ELECTRONICS HOUSING

This application is a national phase of International Application No. PCT/EP2013/063124 filed Jun. 24, 2013.

FIELD OF THE INVENTION

The invention relates to a pin contact element support made of insulating material and having at least two pin contacts which are installed in the contact support, wherein the pin contact element is intended to be installed in an electronics device housing and to be connected to a printed circuit board.

The invention also relates to an electronics device housing for lined-up arrangement side by side on a mounting rail and having at least one such pin contact element.

BACKGROUND ART

Pin contact elements are sufficiently known in the form of plug connectors or headers to be soldered onto a printed circuit board. In the case of such headers, the individual pin contacts are arranged side by side in a single row or in two rows and optionally are angled. The free ends intended to be soldered into a printed circuit board extend here in a direction perpendicular to the direction of the free ends intended for connection of a plug connector. The plane spanned by the straight contact portions for connection of a plug connector transitions starting from free ends to be angled into a plane arranged perpendicularly hereto, which is spanned by the free ends intended for attachment to a printed circuit board.

Such a header is described for example in DE 197 14 878 C1 and DE 20 2007 005 387 U1.

EP 0 685 906 A1 discloses a method for producing an electrical device comprising a printed circuit board, in which the printed circuit board is connected by means of terminal blocks. For this purpose, holding blocks having connection lugs are fitted and soldered onto the printed circuit board. Terminal blocks can be loosely plugged onto the connection lugs. The mechanical and electrical connection is produced by insertion into a housing, which secures the terminal blocks on the printed circuit board, and by tightening clamps in order to produce a connection between the connection lugs and conductors to be connected. The rod contacts formed from flat material and having a rectangular cross section are held in a contact carrier made of insulating material, where they are gripped. Soldering lugs to be soldered into a printed circuit board protrude from the contact carrier. Furthermore, following partially exposed angled portions, connection lugs protrude from the contact carrier, and a terminal block with screw clamp connections is fitted onto said connection lugs.

EP 2 088 842 A2 discloses an electronics housing that can be lined up and is to be latched onto a mounting rail. The electronics housing has conductor connections and also a printed circuit board received in the electronics housing. The conductor connections are arranged in conductor connection housings outside the outer edge of the printed circuit board, next to the printed circuit board. Each conductor connection housing has a conductor connection, from which a contact pin intended to be inserted into and soldered to the printed circuit board protrudes.

EP 2 120 296 A1 discloses an electronics housing that can be lined up, having a connector strip for receiving at least one printed circuit board oriented perpendicularly to the direction of the line. The printed circuit board is provided on one side with a header, which is contacted by a connector strip. Headers on the printed circuit board have easily angled soldering pins, which for example are arranged in a 2×2 matrix with two rows.

WO 02/095878 A1 discloses a pin contact element in which:

- the pin contacts protrude from a platform of the contact carrier in order to receive a spring force plug connector having a straight contact portion,
- the straight contact portion of the pin contacts is surrounded in a fixing region of the platform by the contact carrier, and the pin contacts are fixed on the contact carrier in the fixing region,
- at least one of the pin contacts is routed past at least one further pin contact of the same pin contact element via at least two angled portions adjoining the straight contact portion, and
- at least two pin contacts having straight contact portions are arranged side by side in at least one row.

BRIEF SUMMARY OF INVENTION

On this basis, the object of the present invention is to create an improved pin contact element.

The object is achieved with the pin contact elements having the features of claim 1. Advantageous embodiments are described in the dependent claims.

It is proposed for the opposite free ends of these pin contacts, said free ends being intended for connection to a printed circuit board, to extend side by side, parallel to the line direction of the straight contact portions arranged side by side in a row, in at least one row arranged perpendicularly to the plane spanned by the contact pin arrangement in the region of the straight contact portions, and to protrude laterally from the contact carrier.

In this way, it is possible to connect the printed circuit board in a robust and space-saving manner to the pin contact element. The circuit board then also lies in a plane parallel to the direction of the straight contact portions and a direction perpendicular hereto.

An angled portion is understood to mean not only a sharp bend of the pin contact, but also a bend having a larger or smaller radius. The angled portion may have an angle of approximately 90 degrees, that is to say may be right-angled. However, another angle can also be provided where necessary.

Due to the use of pin contacts instead of flat contacts rectangular in cross section or the like, a simple, robust and reliable connection to a spring force plug connector is made possible.

Such a spring force plug connector may be, in particular, a plug connector having an insulating material housing, as described in DE 10 2007 018 443 A1 and DE 10 2009 035 71.6 A1, which are incorporated here fully by reference, wherein the insulating material housing has at least one contact pin plug-in opening on a first housing side for the insertion of electrically conductive contact pins and at least one conductor plug-in opening on a second housing side for the insertion of insulation-free ends of electrical conductors. A pair formed by contact pin plug-in opening and conductor plug-in opening is in each case assigned a common conductor connection space. The conductor plug-in opening opens out into the conductor connection space, and the conductor plug-in opening has a passage to the conductor connection space. The plug connector additionally has a spring force clamping connection in an associated conductor connection space with a spring element bent preferably in a U shape, which has a clamping portion, which can be displaced by spring force transversely to the direction of extension of a pair formed by contact pin plug-in opening and conductor opening, in such a way that, when introducing an insulation-free end of an electrical conductor into the conductor plug-in opening, the insulation-free end is pressed in the direction of the contact pin plug-in opening. The at least one contact pin plug-in opening, over a length in the direction of extension thereof oriented from the first housing side to the second housing side, has, at least in the region above the clamping portion in the direction of the second housing side and below the clamping portion in the direction of the first housing side, a width of the passage that is smaller than the width between the opposite side walls of the conductor connection space adjacent to the transition to the contact pin plug-in opening. Due to the reduced width of the passage of the contact pin plug-in opening to the conductor connection space, a physical separation is achieved between the conductor connection space and contact pin plug-in opening, and the insulation-free end of an electrical conductor is prevented from being pressed by the spring element into the contact pin plug-in opening to such an extent that it causes an obstruction and an insertion of a contact pin into the contact pin plug-in opening is prevented. The passage of the contact pin plug-in opening to the conductor connection space serves as a displacement region for the electrical conductor, which can plunge in part into this passage, in order to push back the electrical conductor, following insertion of a contact pin, against the spring force in the direction of the conductor connection space. Here, reliable electrical contact between the contact pin and the electrical conductor, which is arranged directly adjacently or distanced by an intermediate metal sheet, is ensured, said electrical conductor in turn being pressed against the contact pin by the spring force of the spring element.

Since, in a fixing region adjacent to the platform, the straight contact portion of the pin contacts is surrounded on all sides by the contact carrier and is fixed there on the contact carrier, a sufficiently stable design of the pin contact element is achieved in order to receive spring force plug connector.

It is particularly advantageous if all contact pins are arranged side by side in a row via their straight contact portions. With such a contact pin arrangement in a single row, the above-mentioned spring force plug connectors can be used for example and it is possible, at the opposite ends in a plane arranged perpendicularly to the arrangement of contact pins in a single row in the region of the straight contact region, to contact a printed circuit board with an arrangement of pin contacts in two rows for connection of a printed circuit board.

For the connection to the printed circuit board, the pin contacts are preferably arranged offset from one another. A very stable and space-saving connection of the pin contacts to a printed circuit board and for installation in an electronics device housing can thus be achieved. The arrangement is favorable in order to maintain the necessary clearances and creepage distances on the printed circuit board.

It is particularly advantageous if the pin contacts, at least at a support region, rest on an associated support base of the contact carrier in an angled portion between the straight contact portion and the opposite free ends intended for connection to a printed circuit board. The pin contacts are thus received in a stable manner in the contact carrier under consideration of the necessary clearances and creepage distances.

In this embodiment, it is advantageous if the pin contacts, at the at least one support region, rest only on one side on the support base in the direction of the platform and are freely accessible on the side opposite the platform. The pin contacts can thus press via their straight contact portion into the platform of the contact carrier during manufacture.

The at least one support base can be formed for example on separating webs, which protrude from the platform. These separating webs thus serve to form the support base and ensure sufficient stability. Here, they are preferably arranged between adjacent pin contacts and, in addition to maintaining the necessary clearances and creepage distances, also form necessary intermediate walls where appropriate.

It is also advantageous if the contact carrier has a guide wall, which protrudes from the platform and which extends parallel to the straight contact portions of the pin contacts. A spring force plug connector can be easily and reliably inserted with the aid of this guide wall. The guide wall can also be used to receive coding grooves.

The guide wall is preferably formed integrally from the insulating material of the contact carrier.

The pin contacts are preferably formed both in the straight contact portion and at the adjoining angled portion equally with substantially the same cross section. Here, the cross section in particular may be a round, oval or polygonal cross section, these cross sections being suitable for receiving spring force plug connectors at the straight contact portion.

The object is also achieved by electronics device housings for lined-up arrangement side by side on a mounting rail, said, housings having a housing base, which has latching elements for latching on a mounting rail, two mutually distanced side walls, a cover portion opposite the housing base, and having a front end face and a rear end face arranged opposite the front end face. The end faces each extend from the housing base to the cover portion between the outer edges of the end face. A space for receiving at least one printed circuit board is formed by the side walls, the housing base, the cover portion and the front and rear end faces.

At least one above-described pin contact element is arranged on at least one of the end faces for connection of associated spring force plug connectors.

The pin contact elements are preferably arranged in the electronics device housing in such a way that the straight contact portions extend via the free ends thereof in a direction from the housing base to the cover portion. In this way, a spring force clamping element can then be plugged from above onto the pin contact element from the direction of the cover side in the direction of the housing base.

BRIEF DESCRIPTION OF THE DRAWINGS

The invention will be explained in greater detail hereinafter on the basis of exemplary embodiments with the accompanying drawings, in which.

DETAILED DESCRIPTION OF INVENTION

Figure 1:
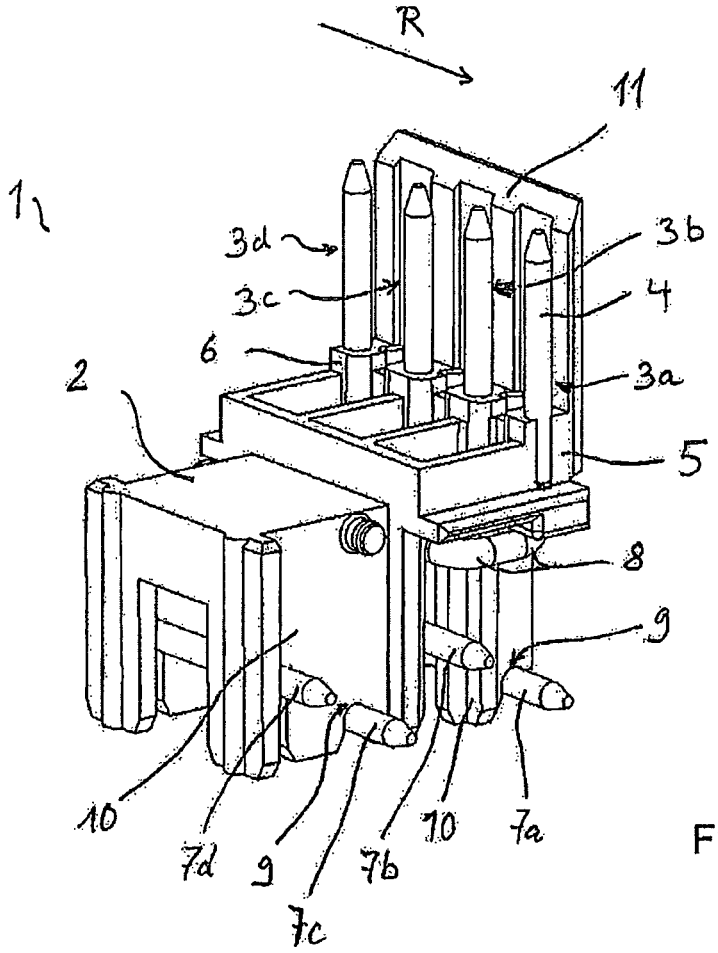
FIG. 1—shows a perspective view of a four-pole embodiment of a pin contact element.

FIG. 1 shows a perspective view of a four-pole embodiment of a pin contact element 1, which is formed from a contact carrier 2 made of insulating material, in particular plastic, and four pin contacts 3*a*, 3*b*, 3*c*, 3*d* installed in the contact carrier 2. The pin contacts 3*a*, 3*b*, 3*c*, 3*d* each have a straight contact portion 4, which protrudes upwardly via the fee end thereof from a platform 5 of the contact carrier 2. It is clear that the straight contact portion is surrounded by the insulating material of the contact carrier 2 and is secured to the contact carrier 2 in this fixing region 6. With the aid of these straight contact portions 4 enclosed by a periphery of more than 180 degrees and preferably more than 270 degrees or completely, these are held in a stable manner in the surrounded or fixing region.

It is also clear that the pin contacts 3*a*, 3*b*, 3*c*, 3*d* are angled below the platform 5, such that free ends 7*a*, 7*b*, 7*c*, 7*d* protrude from the contact carrier 2, laterally from the contact carrier 2, for connection to a printed circuit board. The direction of extension of these free ends 7*a*, 7*b*, 7*c*, 7*d* is perpendicular here to the direction of extension of the straight contact portions 4 and is parallel to the line direction R of the pin contacts 3*a*, 3*b*, 3*c*, 3*d* arranged side by side in a row.

It can also be seen that the pin contacts 3*a*, 3*b*, 3*c*, 3*d* are routed past one another via angled portions 8 such that the free ends 7*a*, 7*b*, 7*c*, 7*d* intended for connection to a printed circuit board are routed past one another without collision and maintaining the necessary clearances and creepage distances, and protrude laterally from the contact carrier 2.

In this way, a printed circuit board can be connected laterally to the contact carrier 2, said circuit board having bores for receiving the free ends 7*a*, 7*b*, 7*c*, 7*d* and for soldering said free ends to the printed circuit board. The printed circuit board would then extend in a plane that is spanned on the one hand by the direction of the straight contact portions and on the other hand by a direction perpendicular to the straight contact portion 4 and the free ends 7*a*, 7*b*, 7*c*, 7*d* for connection to the printed circuit board.

It can also be seen that the free ends 7*a*, 7*b*, 7*c*, 7*d* for connection to the printed circuit board rest on an associated support base 9, which is formed in each case on a separating web 10 of the contact carrier 2. This support base may be, for example, an indentation, which is shaped in the manner of a part circle and into which the respective pin contact 3*a*, 3*b*, 3*c*, 3*d* is then inserted from below in the direction of the platform 5. On the side opposite the platform 5, the pin contact 3*a*, 3*b*, 3*c*, 3*d* is by contrast freely accessible in the support region, such that the pin contacts 3*a*, 3*b*, 3*c*, 3*d* can be inserted from below into the contact carrier during manufacture and can be pressed into the contact carrier 2 or, where appropriate, can be press-fit stemmed.

It can also be seen that a guide wall 11 is formed integrally with the contact carrier 2 on the rear side of the contact carrier 2 adjacent to the platform 5. The guide wall 11 extends parallel to the straight contact portions 4 and spans a plane that is spanned parallel to the straight contact portions 4 of the straight pin contacts 3*a*, 3*b*, 3*c*, 3*d* lined up side by side in a row.

A space is provided between the straight contact portions 4 and the guide wall 11, such that a plug connector having spring force clamping contact can be plugged onto the pin contacts 3*a*, 3*b*, 3*c*, 3*d* in a manner bearing against the guide wall 11.

Figure 2:
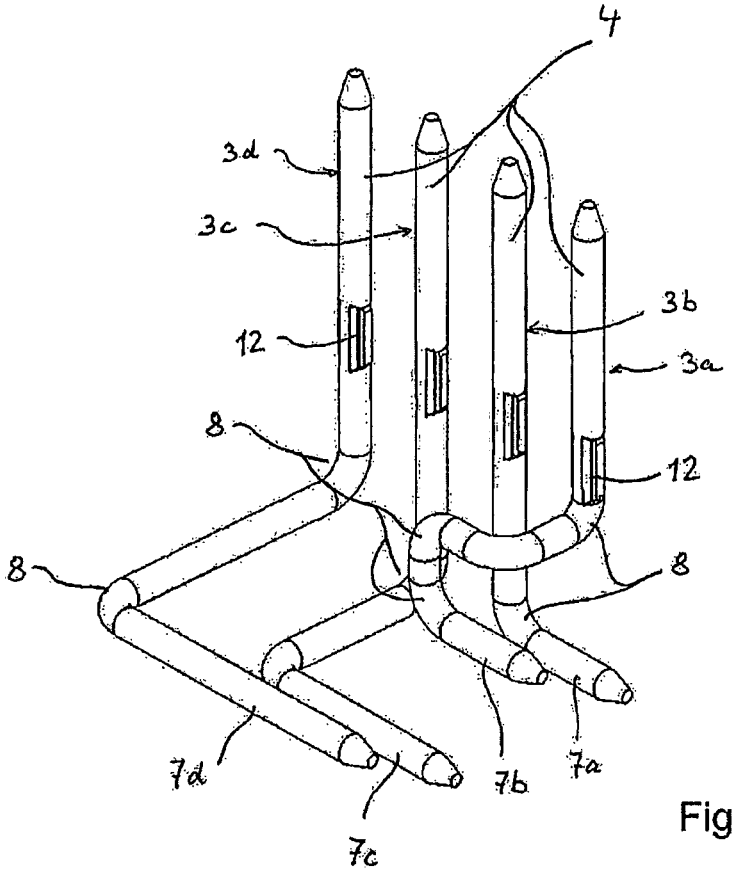
FIG. 2—shows a perspective view of the four pin contacts of the four-pole pin contact element from FIG. 1.

FIG. 2 shows a perspective illustration of the pin contacts 3*a*, 3*b*, 3*c*, 3*d* from FIG. 1. It can be seen that the straight contact portions 4 are lined up side by side in a row and span a common plane. The straight contact portions 4, in the lower region, have latching elements 12 or moldings in the form of mutually opposed latching protrusions and adjacent indentations. These latching elements 12 are formed for example by reshaping the pin contact of round cross section. The latching elements are used to press-fit stem the pin contact 3*a*, 3*b*, 3*c*, 3*d* in the insulating material housing of the contact carrier 2 and to fix said pin contact there.

For each pin contact 3*a*, 3*b*, 3*c*, 3*d*, the straight region 4 is then adjoined firstly by an angled portion 8, wherein one of the pin contacts 3*b* has only a single angled portion 8 in the direction of the common direction of extension of the free ends 7*a*, 7*b*, 7*c*, 7*d* for connection to a printed circuit board.

The other pin contacts are firstly deflected in a direction pointing perpendicularly hereto toward the rear face of the contact carrier. At least one further angled portion 8 then follows, such that the pin contacts 3*a*, 3*b*, 3*c*, 3*d* are routed past one another whilst maintaining the necessary clearances and creepage distances, and the free ends 7*a*, 7*b*, 7*c*, 7*d* protrude laterally away in a common direction.

It can also be seen that the free ends 7*a*, 7*b*, 7*c*, 7*d* for connection of a printed circuit board do not lie in a common plane, but are arranged vertically offset from one another alternately. Thus, not only can the distance be enlarged in order to increase the clearances and creepage distances on the printed circuit board, but the connection of a printed circuit board can also be improved. The offset arrangement not only leads to a more stable connection of the pin contact element 1 on a printed circuit board, but also enables an improved guidance of conductor paths to the free ends 7*a*, 7*b*, 7*c*, 7*d*.

Figure 3:
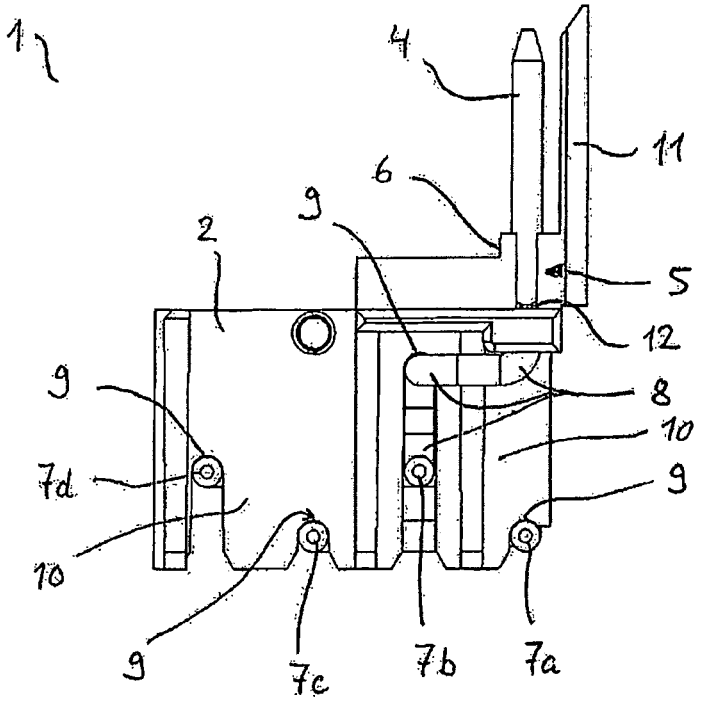
FIG. 3—shows a side view of the pin contact element from FIG. 1.

FIG. 3 shows a side view of the pin contact element 1 from FIG. 1. The free ends 7*a*, 7*b*, 7*c*, 7*d* protrude laterally from the contact carrier 2 for connection to a printed circuit board.

It can also be seen that the guide wall 11 protrudes upwardly, parallel to the direction of extension of the straight contact portions 4.

It can also be seen that the pin contacts, at support regions, rest on support bases 9, which are formed as cavities, shaped in the manner of a part circle, in the contact carrier 2. These cavities are downwardly open, such that the free ends 7*a*, 7*b*, 7*c*, 7*d* are open downwardly, that is to say in a direction opposite the platform.

Figure 4:
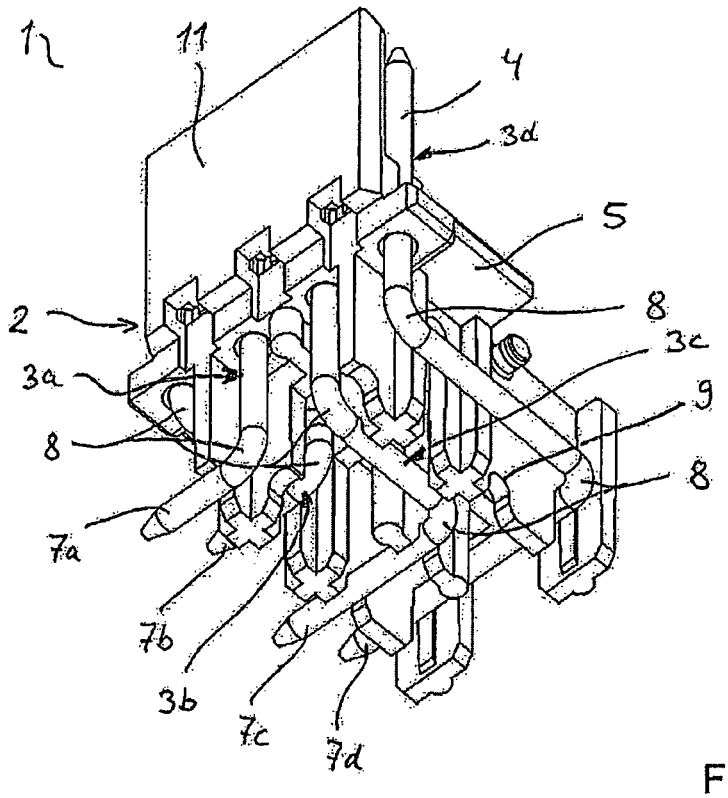
FIG. 4—shows a perspective view of the underside of the pin contact element from FIG. 1.

FIG. 4 shows a perspective view of the pin contact element 1 from FIGS. 1 and 3 from below. Here, it is possible to see even more clearly how the pin contacts 3*a*, 3*c* and 3*d* are routed past the further pin contacts 3*a*, 3*b*, 3*c*, 3*d* of the same pin contact element 1 via at least two angled portions 8 adjoining the respective straight contact portion 4.

It is additionally clear that the contact carrier 2 has further, unused support bases 9. These are provided in order to receive differently bent pin contacts 3*a*, 3*b*, 3*c*, 3'*d* where necessary and to support said pin contacts, for example in order to guide these out not on the illustrated side, but on the opposite side. Without changing the contact carrier 2 itself, a further variant of the pin contact element can therefore be produced by use of differently bent pin contacts.

Figure 5:
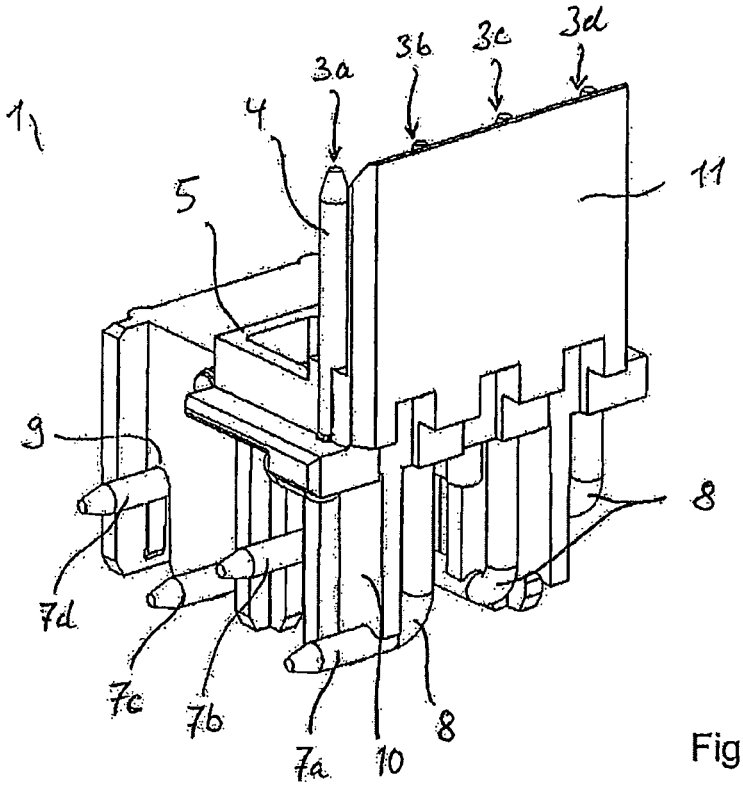
FIG. 5—shows a perspective rear view of the pin contact element from FIG. 1.

FIG. 5 shows a perspective front view of the pin contact element 1 from FIG. 1. It is clear here that the front side is delimited adjacently to the platform by the guide element 11. The straight contact portions 4 of the pin contacts 3*a*, 3*b*, 3*c*, 3*d* then lie behind this guide element 11.

Figure 6:
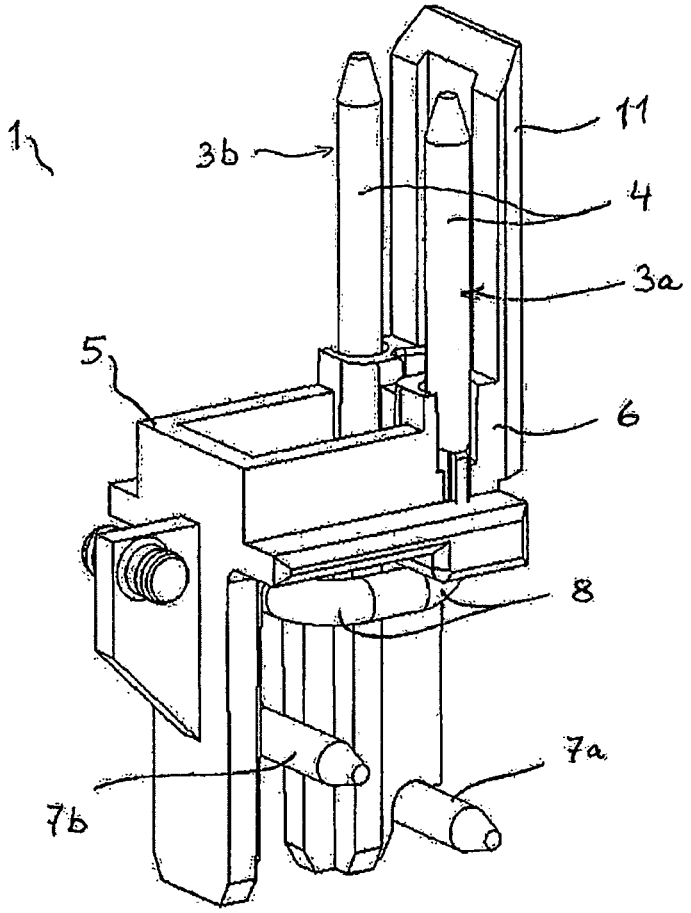
FIG. 6—shows a perspective view of a two-pole embodiment of the pin contact element.

FIG. 6 shows a perspective view of a two-pole pin contact element 1. Here, only two pin contacts 3*a*, 3*b* are provided, which are arranged side by side in a row via the straight contact portion 4 thereof.

The first pin contact 3*a* is guided around the second pin contact 3*a*, which is bent once, with the aid of a number of 90-degree angled portions 8 (four angled portions).

This corresponds substantially to the embodiment of the four-pole embodiment, and therefore reference can be made to the description in that respect.

Figure 7:
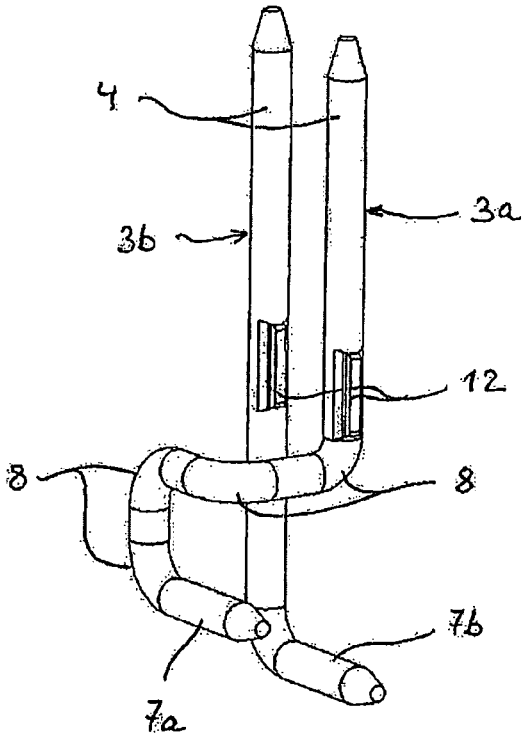
FIG. 7—shows a perspective view of the pin contacts of the pin contact element from FIG. 6.

FIG. 7 shows a perspective illustration of the two pin contacts 3*a*, 3*b*, of which the orientation corresponds to the two pin contacts 3*a*, 3*b* of the four-pole version from FIG. 2.

Figure 8:
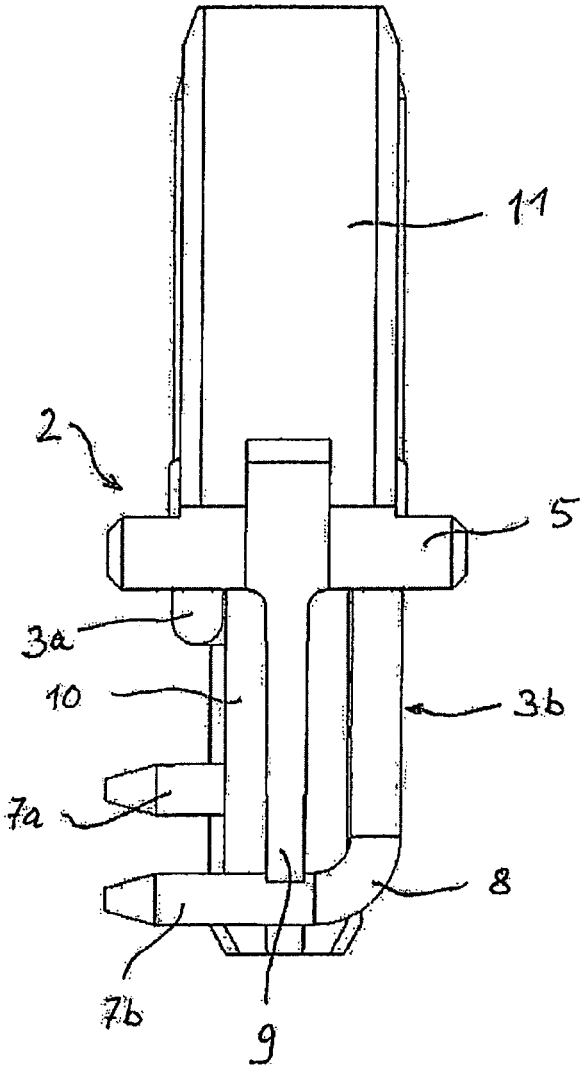
FIG. 8—shows a rear view of the pin contact element from FIG. 6.

FIG. 8 shows a rear view of the two-pole pin contact element 1 from FIG. 6. Here, it can be seen that the right pin contact 3*b* bent once has an angled portion 8 and, adjacently to the angled portion 8, rests on a support 9 arranged on a separating web 10.

The free end 7*a* of the pin contact 3*a* is guided out laterally from the contact carrier 2 in a manner offset upwardly in the direction of the platform 5 and behind the free end 7*b* of the pin contact 3*b* via a number of bends (four angled portions).

Figure 9:
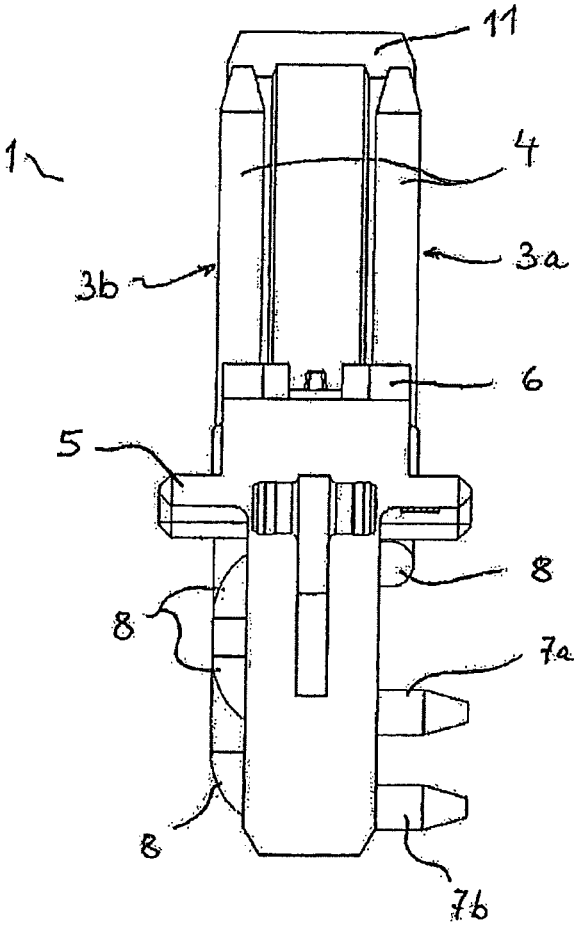
FIG. 9—shows a front view of the pin contact element from FIG. 6.

This can be seen much more clearly from FIG. 9, which shows the two-pole pin contact element in a view from the front.

Figure 10:
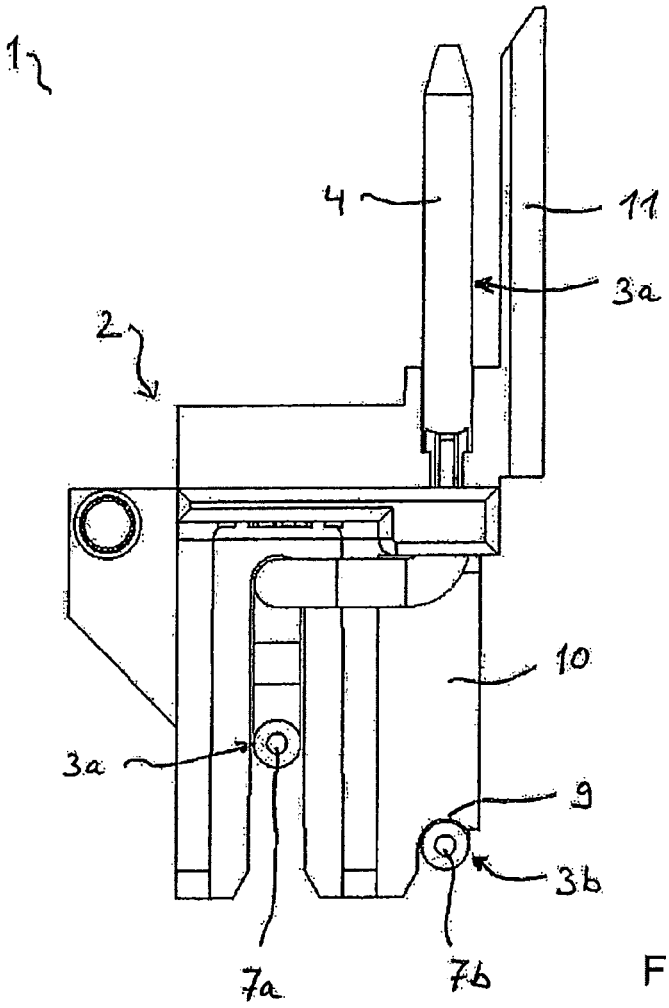
FIG. 10—shows a side view of the pin contact element from FIG. 6.

FIG. 10, comparable with the four-pole embodiment from FIG. 3, shows a side view of the bearing of the portions adjoining the straight contact portion 4 on associated support bases 9 of separating webs 10 of the contact carrier 2.

The vertical offset of the free ends 7*a*, 7*b* and the fact that the free end 7*a* of the first outer pin contact 3*a* does not lie directly below the straight contact portion 4 of this pin contact 3*a*, but is offset to the left, as is also discernable in the four-pole version, is also clear here. By contrast, the free end 7*b* of the adjacent pin contact 3*b* is located below the straight contact portion 4 of the first pin contact 3*a*. Compared with the order of the straight contact portions 4 of the pin contacts 3*a*, 3*b*, the order of the free ends 3*a*, 3*b* for connection to a printed circuit board is thus swapped.

Figure 11:
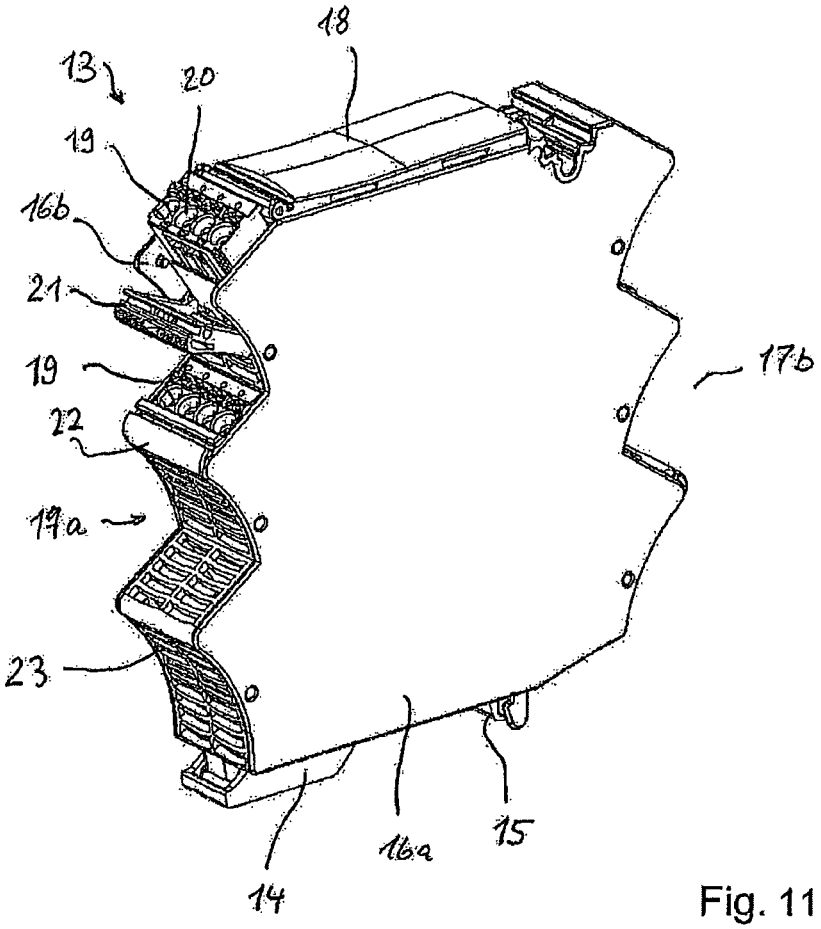
FIG. 11—shows a perspective view of an electronics housing with pin contact elements and spring force plug connectors.

FIG. 11 shows a perspective view of an electronics device housing 13, which is provided for lined-up arrangement side by side on a mounting rail (not shown). To this end, the electronics device housing has a housing base 14 having latching elements 15 known per se for latching on a mounting rail. Two mutually distanced side walls 16*a*, 16*b* are provided laterally adjacently to the housing base 14 and delimit a front end face 17*a* and rear end face 17*b*. A cover portion 18 having a closure cover, which for example can be hinged, is provided opposite the housing base 14. The electronics device housing 13 preferably has an intermediate frame, which is terminated laterally by the side walls 16*a*, 16*b*. The housing base 14 may be an integral part of the intermediate frame.

A receiving space for at least one printed circuit board is formed by the side walls 16*a*, 16*b*, the housing base 14, the cover portion 18 and the front and rear end face 17*a*, 17*b*.

On at least one of the end faces 17*a*, 17*b*, at least one of the previously described pin contact elements 1 is incorporated into the electronics housing 13, for example by latching into associated latching elements on the side walls 16*a*, 16*b*. The straight contact portions 4 of the pin contact elements 1 pointing from the housing base 14 in the direction of the cover portion 18 can then also be plugged into spring force plug connectors 19 in the manner described in the introduction. It can be seen that the spring force plug connectors 19 have conductor insertion openings 20 arranged in a single row, which are matched to the distance between the pin contacts 3*a*, 3*b*, 3*c*, 3*d* of a four-pole pin contact element 1 in order to contact conductors introduced into the conductor insertion opening 20 by means of spring force by direct bearing on the pin contacts 3*a*, 3*b*, 3*c*, 3*d* or via interposed intermediate metal sheet.

The spring force plug connectors 19 can be removed from the pin contact element 1 via an ejector element 21 mounted pivotably on the side walls 16*a*, 16*b* of the electronics housing 13. The pivotably mounted ejector elements 21 are also used in the plugged-in state of a spring force plug connector 19 to lock said connector on the electronics device housing 13 with the aid of a protruding locking web. In order to eject a spring force plug connector 19, the ejector elements 21 have prongs protruding in an L-shaped manner, which engage the spring force plug connector 19 from below.

In the middle portion, a fixed locking element 22 is provided, by means of which the spring force plug connector 19 is fixedly connected to the electronics device housing 13 in the state fitted onto the pin contact element 1. Without disassembly of the electronics device housing 13, this spring force plug connector 19 therefore cannot be removed.

In the lower region, a blind cap 23 with ventilation openings is installed, for the case that no plug contact connector is required there.

However, the electronics device housing 13 offers the possibility selectively at the three illustrated levels both on the front end face 17*a* and on the rear end face 17*b* to handle spring force plug connectors removable by means of ejectors, fixedly locked plug connectors, or no spring force plug connector.

Figure 12:
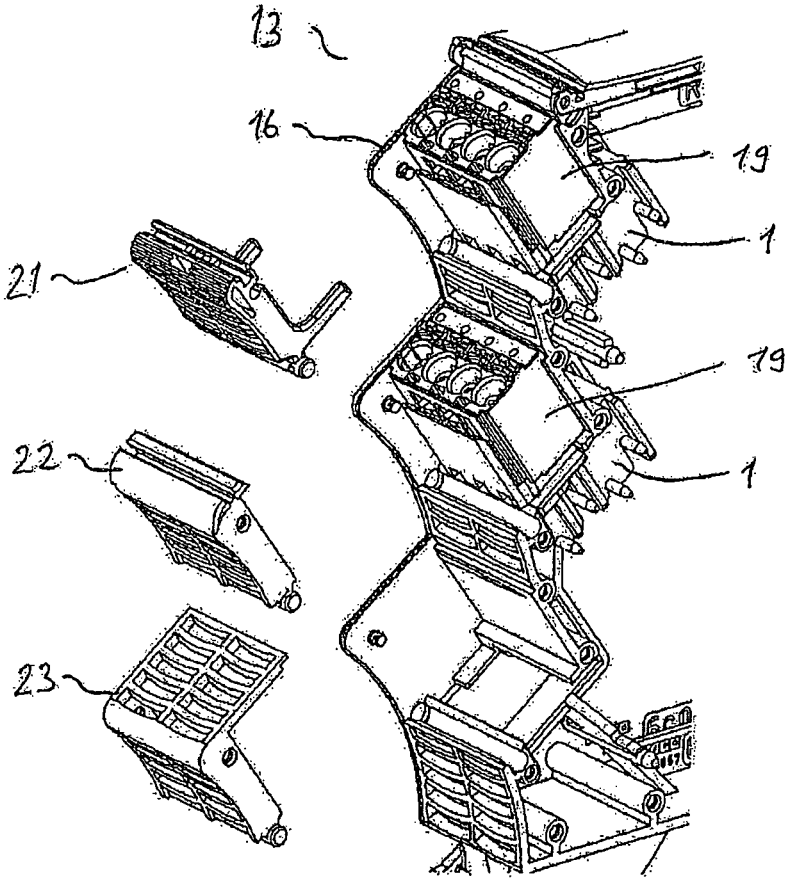
FIG. 12—shows an exploded view of a detail of the electronics device housing from FIG. 11.

FIG. 12 shows these three variants with pivotable ejector element 21 for locking and unlocking a plug connector 19, with fixed locking element 22, and with a blind cap 23 having ventilation openings in an exploded illustration.

It is also clear that the pin contact elements 1 in the middle and upper plane are installed in the electronics device housing 13 by being latched to an intermediate frame or to the side wall 16*b*.

The invention claimed is:

1. A pin contact element having a contact carrier made of insulating material and having at least two pin contacts installed in the contact carrier, wherein the pin contact element is intended to be installed in an electronics device housing and to be connected to a printed circuit board, wherein the pin contacts protrude from a platform of the contact carrier in order to receive a spring-force plug connector via a straight contact portion, the straight contact portion of the pin contacts is surrounded in a fixing region of the platform by the contact carrier, and the pin contacts are secured to the contact carrier in the fixing region, at least one of the pin contacts is routed past at least one further pin contact of the same pin contact element via at least two angled portions adjoining the straight contact portion, and at least two pin contacts are arranged with their straight contact portions in a row side by side, wherein the opposite free ends of these pin contacts, said free ends being intended for connection to a printed circuit board, extend side by side, parallel to the line direction of the straight contact portions, in at least one row arranged perpendicularly to the plane spanned by the contact pin arrangement in the region of the straight contact portion, and protrude laterally from the contact carrier.

2. The pin contact element as claimed in claim 1, wherein all pin contacts are arranged side by side in a row via their straight contact portions.

3. The pin contact element as claimed in claim 1, wherein the free ends of the pin contacts, said free ends being intended for connection to a printed circuit board, are arranged vertically offset from one another alternately and do not lie at a common height.

4. The pin contact element as claimed in claim 1, wherein the pin contacts, at least at one support region of the pin contacts, rest on an associated support base of the contact carrier in the angled portion between the straight contact portion and the opposite free end intended for connection to a printed circuit board.

5. The pin contact element as claimed in claim 4, wherein the pin contacts, at the at least one support region, rest only on one side on the support base in the direction of the platform and are freely accessible on the side opposite the platform.

6. The pin contact element as claimed in claim 4, wherein at least one of the support bases is formed on separating webs protruding away from the platform.

7. The pin contact element as claimed in claim 1, wherein the contact carrier) has a guide wall, which protrudes from the platform and which extends parallel to the straight contact portions of the pin contacts.

8. The pin contact element as claimed in claim 7, wherein the guide wall is formed integrally with the contact carrier from insulating material.

9. The pin contact element as claimed in claim 1, wherein the pin contacts are round, oval or polygonal, both in the straight contact portion and in the adjoining angled portion.

10. An electronics device housing for lined-up arrangement side by side on a mounting rail, having:

a housing base, which has latching elements for latching on a mounting rail, two mutually spaced side walls, a cover portion opposite the housing base, and a front end face and a rear end face opposite the front end face, wherein the end faces each extend from the housing base to the cover portion between the outer edges of the side walls, and wherein a space for receiving at least one printed circuit board is formed by the side walls, the housing base, the cover portion and the front and rear end face, wherein at least one pin contact element as claimed in claim 1 is arranged on at least one of the end faces for connection of associated spring-force plug connectors.

11. The electronics device housing as claimed in claim 10, wherein the pin contact elements are arranged in the electronics device housing in such a way that the straight contact portions extend via the free ends thereof in a direction from the housing base to the cover portion.

* * * * *